US009188290B2

(12) United States Patent
Lay et al.

(10) Patent No.: US 9,188,290 B2
(45) Date of Patent: Nov. 17, 2015

(54) INDIRECT LINEAR FIXTURE

(71) Applicant: CREE, INC., Durham, NC (US)

(72) Inventors: Michael Lay, Cary, NC (US); Nathan Snell, Raleigh, NC (US)

(73) Assignee: Cree, Inc., Durham, NC (US)

( * ) Notice: Subject to any disclaimer, the term of this patent is extended or adjusted under 35 U.S.C. 154(b) by 309 days.

(21) Appl. No.: 13/834,605

(22) Filed: Mar. 15, 2013

(65) Prior Publication Data

US 2013/0286637 A1 Oct. 31, 2013

Related U.S. Application Data

(60) Provisional application No. 61/622,482, filed on Apr. 10, 2012, provisional application No. 61/705,585, filed on Sep. 25, 2012.

(51) Int. Cl.

| | |
|---|---|
| ***F21K 99/00*** | (2010.01) |
| ***F21S 8/02*** | (2006.01) |
| ***F21S 8/04*** | (2006.01) |
| ***F21S 8/06*** | (2006.01) |
| ***F21V 7/00*** | (2006.01) |
| ***F21V 23/00*** | (2015.01) |
| ***F21V 29/70*** | (2015.01) |
| *F21V 25/12* | (2006.01) |
| *F21V 21/02* | (2006.01) |
| *F21Y 101/02* | (2006.01) |
| *F21Y 103/00* | (2006.01) |

(52) U.S. Cl.

CPC . *F21K 9/17* (2013.01); *F21S 8/026* (2013.01); *F21S 8/04* (2013.01); *F21S 8/06* (2013.01); *F21V 7/0008* (2013.01); *F21V 23/009* (2013.01); *F21V 29/70* (2015.01); *F21V 21/02* (2013.01); *F21V 25/12* (2013.01); *F21Y 2101/02* (2013.01); *F21Y 2103/003* (2013.01)

(58) Field of Classification Search

USPC ..... 362/218, 221, 217.05, 294

See application file for complete search history.

(56) References Cited

U.S. PATENT DOCUMENTS

| | | | | |
|---|---|---|---|---|
| 4,946,547 | A | 8/1990 | Palmour et al. | |
| 5,200,022 | A | 4/1993 | Kong et al. | |
| RE34,861 | E | 2/1995 | Davis et al. | |
| 5,690,415 | A | 11/1997 | Krehl | 362/125 |
| 5,823,663 | A | 10/1998 | Bell et al. | |
| 5,951,150 | A | 9/1999 | Helstern | 362/293 |
| 6,210,025 | B1 | 4/2001 | Schmidt et al. | |
| 6,536,924 | B2 | 3/2003 | Segretto | 362/345 |

(Continued)

OTHER PUBLICATIONS

U.S. Appl. No. 13/649,052, filed Oct. 10, 2012, Lowes, et al.

(Continued)

*Primary Examiner* — Laura Tso

(74) *Attorney, Agent, or Firm* — Koppel, Patrick, Heybl & Philpott

(57) ABSTRACT

A light fixture comprising a chamber portion is disclosed. In some embodiments, the fixture comprises a chamber portion shaped to house circuitry required for lighting elements such as light emitting diodes (LEDs) mounted elsewhere in the fixture. In some embodiments, LEDs are mounted facing a back reflector, which in turn reflects light out of a troffer to form an indirect lighting fixture. In some embodiments, light is emitted from one mixing chamber. In some embodiments, light is emitted from two or more mixing chambers. In some embodiments, LEDs are mounted on a heat sink which cooperates with a chamber portion.

26 Claims, 12 Drawing Sheets

(56) References Cited

U.S. PATENT DOCUMENTS

| | | | | |
|---|---|---|---|---|
| 6,667,451 | B1 | 12/2003 | Hart | 200/314 |
| 6,739,734 | B1 | 5/2004 | Hulgan | 362/243 |
| 6,914,194 | B2 | 7/2005 | Fan | |
| 7,213,940 | B1 | 5/2007 | Van De Ven et al. | |
| 7,217,023 | B2 | 5/2007 | Iwasa et al. | 362/555 |
| 7,387,410 | B2 | 6/2008 | Sibout | 362/375 |
| 7,540,627 | B2 | 6/2009 | Handsaker | 362/225 |
| 7,628,506 | B2 | 12/2009 | Verfuerth et al. | 362/218 |
| 7,654,703 | B2 * | 2/2010 | Kan et al. | 362/362 |
| 7,722,220 | B2 | 5/2010 | Van de Ven et al. | |
| 7,758,207 | B1 * | 7/2010 | Zhou et al. | 362/218 |
| 7,791,061 | B2 | 9/2010 | Edmond et al. | |
| 8,058,088 | B2 | 11/2011 | Cannon et al. | |
| 8,206,004 | B2 | 6/2012 | Serak et al. | 362/217 |
| 8,313,212 | B1 | 11/2012 | Mayer et al. | 362/219 |
| 8,317,369 | B2 | 11/2012 | McCanless | 362/368 |
| 8,376,578 | B2 | 2/2013 | Kong, II | 362/241 |
| 8,459,824 | B1 | 6/2013 | Esmailzadeh et al. | 362/147 |
| 8,523,383 | B1 | 9/2013 | Grigore et al. | 362/221 |
| 8,764,220 | B2 | 7/2014 | Chan et al. | 362/217.02 |
| 2004/0240214 | A1 | 12/2004 | Whitlow et al. | 362/373 |
| 2005/0146867 | A1 | 7/2005 | Kassay et al. | 362/217 |
| 2006/0050505 | A1 | 3/2006 | McCarthy et al. | 362/219 |
| 2007/0158668 | A1 | 7/2007 | Tarsa et al. | |
| 2008/0128723 | A1 | 6/2008 | Pang | |
| 2008/0173884 | A1 | 7/2008 | Chitnis et al. | |
| 2008/0179611 | A1 | 7/2008 | Chitnis et al. | |
| 2008/0258130 | A1 | 10/2008 | Bergmann et al. | |
| 2008/0314944 | A1 | 12/2008 | Tsai et al. | 224/331 |
| 2009/0040782 | A1 | 2/2009 | Liu et al. | 362/555 |
| 2009/0046457 | A1 * | 2/2009 | Everhart | 362/235 |
| 2009/0161356 | A1 | 6/2009 | Negley et al. | 362/231 |
| 2009/0184333 | A1 | 7/2009 | Wang et al. | |
| 2009/0207602 | A1 | 8/2009 | Reed et al. | 362/225 |
| 2009/0212304 | A1 | 8/2009 | Wang et al. | |
| 2009/0224265 | A1 | 9/2009 | Wang et al. | |
| 2009/0290345 | A1 | 11/2009 | Shaner | 362/249.01 |
| 2009/0290348 | A1 | 11/2009 | Van Laanen et al. | 362/249 |
| 2009/0296381 | A1 | 12/2009 | Dubord | 362/218 |
| 2010/0142205 | A1 | 6/2010 | Bishop | 362/249.02 |
| 2010/0155763 | A1 | 6/2010 | Donofrio et al. | |
| 2010/0171404 | A1 * | 7/2010 | Liu et al. | 313/46 |
| 2010/0214770 | A1 | 8/2010 | Anderson | 362/133 |
| 2010/0214785 | A1 * | 8/2010 | Chen | 362/267 |
| 2010/0220469 | A1 | 9/2010 | Ivey et al. | 362/218 |
| 2010/0328945 | A1 * | 12/2010 | Song et al. | 362/240 |
| 2011/0007514 | A1 | 1/2011 | Sloan et al. | 362/368 |
| 2011/0013400 | A1 | 1/2011 | Kanno et al. | |
| 2011/0028006 | A1 | 2/2011 | Shah et al. | 439/39 |
| 2011/0163683 | A1 | 7/2011 | Steele et al. | 315/192 |
| 2011/0211330 | A1 | 9/2011 | Wang | 362/20 |
| 2011/0285314 | A1 | 11/2011 | Carney et al. | 315/294 |
| 2011/0286207 | A1 | 11/2011 | Chan et al. | 362/217.1 |
| 2011/0310604 | A1 | 12/2011 | Shimzu et al. | 362/235 |
| 2012/0002408 | A1 | 1/2012 | Lichten et al. | 362/218 |
| 2012/0051041 | A1 | 3/2012 | Edmond | 362/231 |
| 2012/0075857 | A1 | 3/2012 | Verbrugh | 362/249 |
| 2012/0081883 | A1 | 4/2012 | Wang | 362/101 |
| 2012/0120666 | A1 | 5/2012 | Moeller | 362/308 |
| 2012/0169234 | A1 | 7/2012 | Shew | 315/88 |
| 2012/0218757 | A1 * | 8/2012 | Gill | 362/235 |
| 2012/0235199 | A1 | 9/2012 | Andrews et al. | |
| 2013/0050998 | A1 | 2/2013 | Chu et al. | 362/218 |
| 2013/0094225 | A1 | 4/2013 | Leichner | 362/368 |
| 2013/0271979 | A1 | 10/2013 | Pearson et al. | 362/235 |
| 2013/0279180 | A1 | 10/2013 | Pearson et al. | 362/371 |
| 2013/0329425 | A1 | 12/2013 | Lowes et al. | |
| 2014/0265809 | A1 | 9/2014 | Hussell | |

OTHER PUBLICATIONS

U.S. Appl. No. 13/649,067, filed Oct. 10, 2012, Lowes, et al.
U.S. Appl. No. 13/770,389, filed Feb. 19, 2013, Lowes, et al.
U.S. Appl. No. 13/782,820, filed Mar. 1, 2013, Dixon, et al.
U.S. Appl. No. 13/873,303, filed Aug. 31, 2010, Edmond, et al.
U.S. Appl. No. 13/345,215, filed Jan. 6, 2012, Lu, et al.
U.S. Appl. No. 13/442,311, filed Apr. 9, 2012, Lu, et al.
U.S. Appl. No. 12/463,709, filed May 11, 2009, Donofrio, et al.
U.S. Appl. No. 11/656,759, filed Jan. 22, 2007, Chitnis, et al.
U.S. Appl. No. 11/899,790, filed Sep. 7, 2007, Chitnis, et al.
CircalokTM conductive adhesive, 6972 and 6968, by Lord Corporation, 2 pages.
WhiteOpticstm White97 Film, Reflector Film Technical Data Sheet, WhiteOptics, LLC, New Castle, DE.
Office Action from U.S. Appl. No. 13/829,558, dated Sep. 30, 2014.
Office Action from U.S. Appl. No. 29/450,283, dated Nov. 5, 2014.
Office Action from U.S. Appl. No. 29/449,316, dated Nov. 26, 2014.
Office Action from U.S. Appl. No. 13/840,812, dated Nov. 28, 2014.
Office Action from U.S. Appl. No. 13/763,270, dated Oct. 3, 2014.
Restriction Requirement from U.S. Appl. No. 13/839,130, dated Jul. 28, 2014.
Office Action from U.S. Appl. No. 13/839,130, dated Sep. 25, 2014.
Office Action from U.S. Appl. No. 29/449,316, dated Jun. 5, 2014.
Office Action from U.S. Appl. No. 13/842,150, dated Jun. 18, 2014.
Leviton LED Magnetic Tube Retrofit Series datasheet, 1 page, from www.leviton.com.
Office Action from U.S. Appl. No. 13/672,592, dated Jan. 7, 2015.
Office Action from U.S. Appl. No. 13/899,314, dated Jan. 15, 2015.
Office Action from U.S. Appl. No. 13/842,150, dated Jan. 22, 2015.
Office Action from U.S. Appl. No. 13/829,558, dated Mar. 9, 2015.
Office Action from U.S. Appl. No. 13/958,462, dated Mar. 10, 2015.
Office Action from U.S. Appl. No. 13/840,812, dated May 12, 2015.
Office Action from U.S. Appl. No. 13/910,486, dated May 7, 2015.
Office Action from U.S. Appl. No. 13/763,270, dated May 19, 2015.
Office Action from U.S. Appl. No. 13/899,314, dated Jul. 29, 2015.
Response to OA from U.S. Appl. No, 13/899,314, filed Sep. 15, 2015.
Office Action from U.S. Appl. No. 13/672,592, dated Aug. 6, 2015.
Response to OA from U.S. Appl. No. 13/672,592, filed Sep. 21, 2015.
Office Action from U.S. Appl. No. 13/842,150, dated Aug. 10, 2015.
Office Action from U.S. Appl. No. 13/829,558, dated Sep. 11, 2015.

* cited by examiner

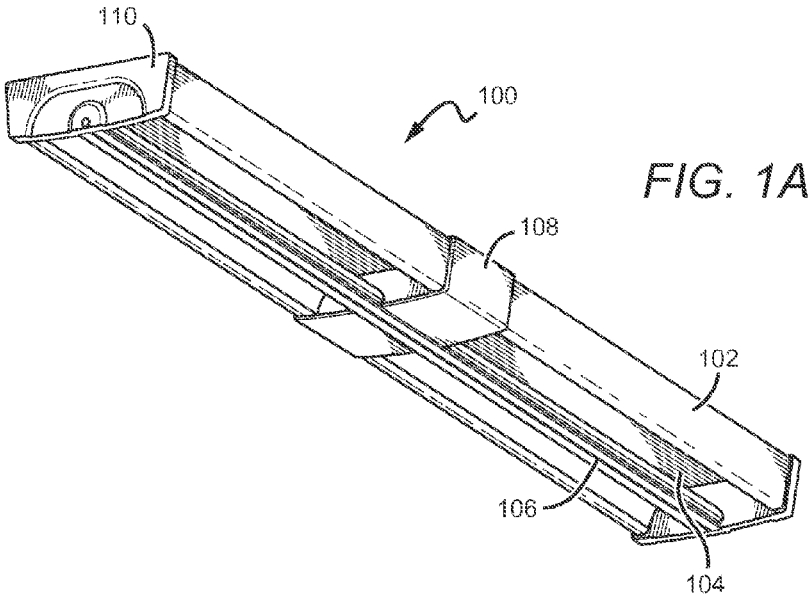
FIG. 1A
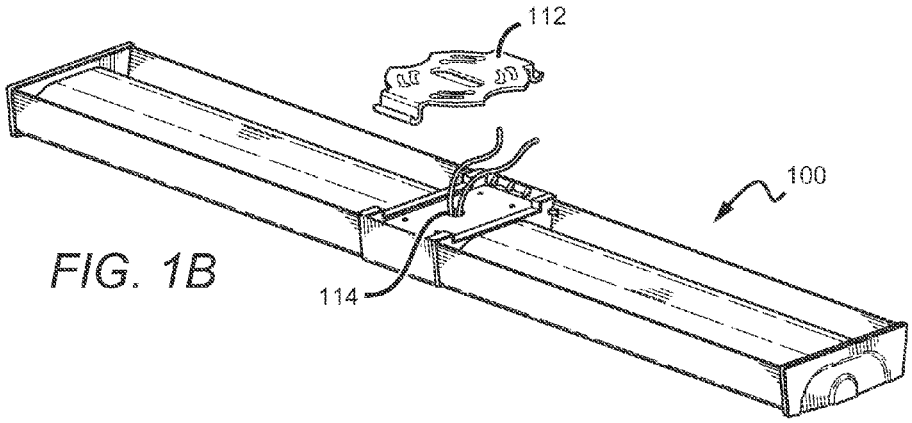
FIG. 1B
FIG. 1C
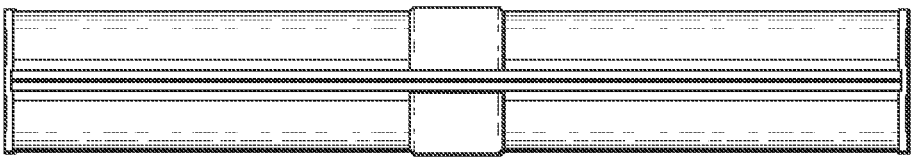

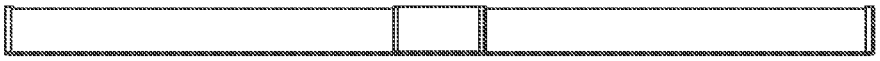
FIG. 1D
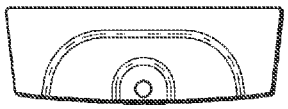
FIG. 1E
FIG. 2
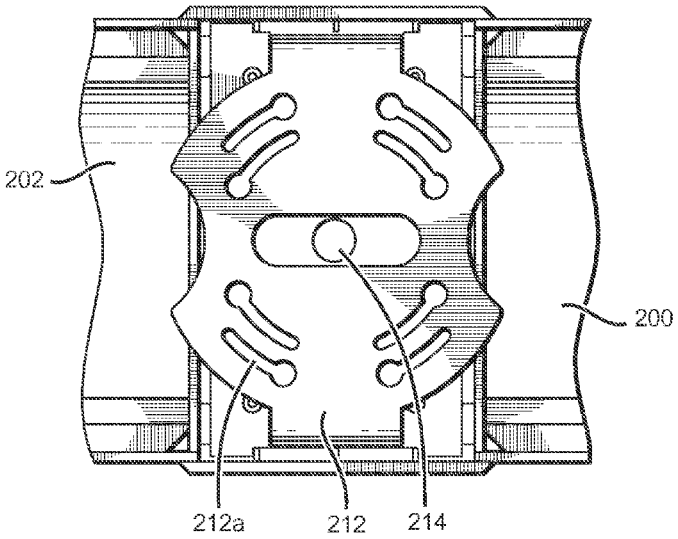
FIG. 3A
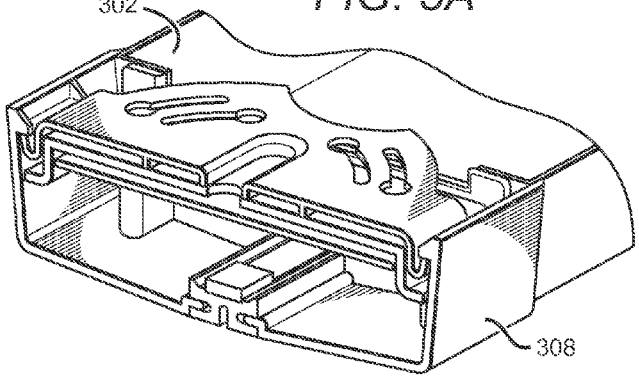

INDIRECT LINEAR FIXTURE

RELATED APPLICATION

This application claims the benefit of U.S. Provisional Application No. 61/622,482, filed on 10 Apr. 2012, and also claims the benefit of U.S. Provisional Application No. 61/705,585, filed on 25 Sep. 2012, both of which are incorporated by reference herein in their entirety.

BACKGROUND OF THE INVENTION

1. Field of the Invention

The invention relates to lighting troffers and, more particularly, to indirect lighting troffers that are well-suited for use with solid state lighting sources, such as light emitting diodes (LEDs).

2. Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a printed circuit board (PCB), substrate or submount. The array of LED packages can comprise groups of LED packages emitting different colors, and specular or other reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "down-converts" some of the blue light, changing it to yellow light. Some of the blue light passes through the phosphor without being changed while a substantial portion of the light is down-converted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Some recent designs have incorporated an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application. Many different types and designs of indirect fixtures are possible.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

One embodiment of a fixture comprises a housing shaped to define an interior surface and a back reflector on the interior surface. The fixture has a heat sink proximate to the back reflector and spanning the length of the housing, and a chamber portion define an internal space shaped to house electrical components. The chamber portion cooperates with the heat sink.

Another embodiment of a fixture has a housing shaped to define two or more interior surfaces, with a back reflector on each of the interior surfaces. The fixture has a heat sink proximate to the back reflectors and spanning the length of the housing. A chamber portion define an internal space shaped to house electrical components. The chamber portion cooperates with the heat sink.

Yet another embodiment of a fixture has a housing with a length and defining an interior space, with a back reflector in the interior space. A heat sin kruns from a first end to a second end of the housing and is proximate to the back reflector. A plurality of light sources are on the heat sink and face the back reflector. The fixture has a chamber portion between the first and second ends of the housing.

BRIEF DESCRIPTION OF THE DRAWINGS

FIGS. 1A-1E are bottom perspective, top exploded perspective, top, side, and end views of a light fixture according to an embodiment of the present invention.

FIG. 2 is a top view of a mount bracket according to an embodiment of the present invention.

FIGS. 3A and 3B are end cut-away view of a light fixture according to an embodiment of the present invention and a magnified perspective cut-away view of a section of a light fixture according to an embodiment of the present invention.

DETAILED DESCRIPTION OF THE INVENTION

Figure 3B:
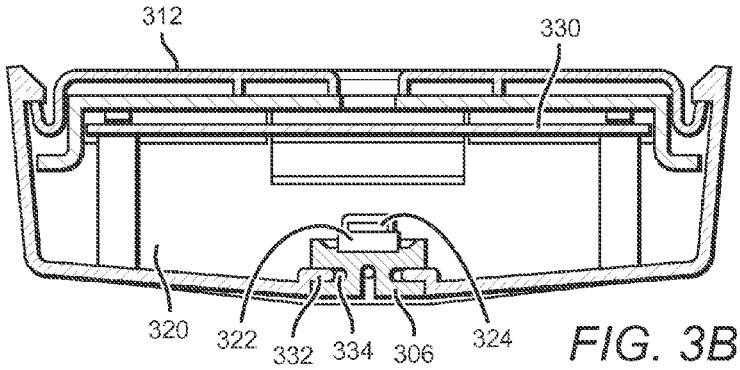

Embodiments of the present invention provide a troffer-style fixture that is particularly well-suited for use with solid state light sources, such as LEDs. The troffer comprises a light engine unit that is surrounded on its perimeter by a reflective pan. A back reflector defines a reflective surface of the light engine. To facilitate the dissipation of unwanted thermal energy away from the light sources, a heat sink is disposed proximate to the back reflector. In some embodiments, one or more lens plates extend from the heat sink out to the back reflector. A portion of the heat sink is exposed to the ambient environment outside of the cavity. The portion of the heat sink inside the facing the back reflector functions as a mount surface for the light sources, creating an efficient thermal path from the sources to the ambient. One or more light sources disposed along the heat sink mount surface emit light into the interior where it can be mixed and/or shaped before it is emitted from the troffer as useful light. Troffers emitting in this way are known as indirect troffers or fixtures (used interchangeably herein). Some indirect fixtures are described in U.S. patent application Ser. No. 12/873,303 to Edmond et al. and entitled "Troffer-Style Fixture," which is commonly assigned with the present application and fully incorporated by reference herein in its entirety.

Because LED sources are relatively intense when compared to other light sources, they can create an uncomfortable working environment if not properly diffused. Fluorescent lamps using T8 bulbs typically have a surface luminance of around 21 $lm/in^2$. Many high output LED fixtures currently have a surface luminance of around 32 $lm/in^2$. Some embodiments of the present invention are designed to provide a surface luminance of not more than approximately 32 $lm/in^2$. Other embodiments are designed to provide a surface luminance of not more than approximately 21 $lm/in^2$. Still other embodiments are designed to provide a surface luminance of not more than approximately 12 $lm/in^2$.

Embodiments of the present invention are designed to efficiently produce a visually pleasing output. Some embodiments are designed to emit with an efficacy of no less than approximately 65 lm/W. Other embodiments are designed to have a luminous efficacy of no less than approximately 76 lm/W. Still other embodiments are designed to have a luminous efficacy of no less than approximately 90 lm/W.

One embodiment of a fixture is designed to achieve at least 88% total optical efficiency with a maximum surface luminance of not more than 32 $lm/in^2$ with a maximum luminance gradient of not more than 5:1. Total optical efficiency is defined as the percentage of light emitted from the light source(s) that is actually emitted from the fixture. Other similar embodiments are designed to achieve a maximum surface luminance of not more than 24 $lm/in^2$. Still other similar embodiments are designed to achieve a maximum luminance gradient of not more than 3:1.

One embodiment of a fixture includes a chamber portion which can house, for example, circuitry and wire connections. This chamber portion can be placed in the middle of the fixture and cooperate with the heat sink. By placing the chamber portion in the middle of the fixture, smaller lenses can be used to reduce costs.

One embodiment of a fixture includes an elongated housing and heat sink. The chamber portion can be placed either in the center of the fixture or on one end. One or more light sources are placed on a mount surface of the heat sink such that the light sources are facing the back reflector. Optionally, the fixture can include one or more lenses, either on the heat sink over the light sources of extending from the heat sink to the back reflector (such that light passes through the lenses after reflecting off of the back reflector). The fixture can also include a flame barrier over the light sources and on the heat sink. In some embodiments, the light sources can have a portion that protrudes through the flame barrier to increase efficiency.

One embodiment of a fixture can be mounted to a ceiling using a universal mount bracket. The mount bracket can cooperate with the fixture housing, for example, a hook-and-flange system. In other embodiments, the fixture can be suspended from a ceiling.

One embodiment of a fixture according to the includes a chamber portion running longitudinally such that the fixture has two mount surfaces, each with its own internal cavity and back reflector section.

Embodiments of the present invention are described herein with reference to conversion materials, wavelength conversion materials, phosphors, phosphor layers and related terms. The use of these terms should not be construed as limiting. It is understood that the use of the term phosphor, or phosphor layers is meant to encompass and be equally applicable to all wavelength conversion materials.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

FIGS. 1A-1E are a bottom perspective, exploded top perspective, bottom, side, and end views of a troffer or fixture (used interchangeably herein) according to the present invention. The troffer 100 may be fit-mounted within a ceiling, mounted to a ceiling, or suspended. The FIG. 1A view of the troffer 100 is from an area underneath the troffer, i.e., the area that would be lit by light sources housed within the troffer. The troffer 100 can have various specifications. For example, a 20" long troffer can have a width of 5.75" and height of 2.0" and weigh less than 2 pounds, and can emit light with a color temperature of 2700K and CRI of 80 when operating at 120-277V/60 Hz and 40 W. A 40" troffer can have these same specifications but with a weight of about 3 pounds. Troffers with other dimensions, such as two foot long and four foot long troffers, are also possible. Troffers with these and similar dimensions are elongated and have elongated housings. These specifications are purely exemplary, as many different variations of fixtures according to the present invention are possible.

The troffer 100 can comprise an elongated housing 102. The elongated housing 102 can be extruded from a plastic material such as polycarbonate, or it can be made of many other suitable materials including, but not limited to, metals. The housing 102 has an interior surface that can serve as a back reflector 104, which can be a highly reflective material and/or be textured (e.g., using micro-mixing optics) to improve color mixing and reduce imaging from the light sources. An elongated heat sink 106 runs longitudinally down the center of the troffer. In some embodiments, the heat sink 106 can provide mechanical support for the fixture. The heat sink should be fabricated from a highly thermally conductive material such as, for example, aluminum. A chamber portion 108 is designed to cooperate with the heat sink 106. In one embodiment, the heat sink 106 is continuous through the chamber portion 108 such that the heat sink 106 spans the length of the housing 102. This provides for increased heat dissipation from the chamber portion 108, as well ease of manufacture and lower cost. In other embodiments the heat sink is not continuous through the chamber portion. In the embodiment shown, the chamber portion 108 is located in the center of the fixture 100, although in other embodiments it may not be in the center and can be anywhere along the fixture 100. In embodiments comprising lenses, placing the chamber portion 108 in the center of the fixture 100 as opposed to on one end of the fixture 100 allows for the use of two smaller lenses covering half of the fixture as opposed to one large lens running the entire length of the fixture, which can decrease manufacturing and tooling costs. The chamber portion 108 provides an internal space for disposing power and driver circuitry and/or wiring connection. The chamber portion 108 protects these elements from outside elements and also helps to prevent shock by users during installation. End caps 110 can be disposed on the ends of the housing 102. The end caps 110 are separate pieces, although other embodiments comprise integral end caps or no end caps.

The housing 102 is shaped to define an interior surface comprising a back reflector 104, although in other embodiments the back reflector 104 is separate from the interior surface of the housing 102. The heat sink 106 is mounted proximate to the back reflector 104. The heat sink 106 comprises a mount surface that faces toward the back reflector 104. The mount surface provides an area where the light sources (not shown) can be mounted to face the back reflector 104. In one embodiment the mount surface is flat and the light sources face the center region of the back reflector, although angled mount surfaces are possible and light sources facing other portions of the back reflector are possible. In some embodiments, the light sources may be mounted to a mount such as a metal core board, FR4 board, PCB, or a metal strip (e.g., aluminum) which can then be mounted to a separate heat sink using, for example, thermal paste, adhesive, and/or screws. In other embodiments a separate light strip or mount is not used. Some embodiments comprise separate or integral heat sinks with fins, while some do not have fins.

With reference to FIGS. 1A, 1B, and 1E, the back reflector 104 can be designed to have several different shapes to perform particular optical functions, including but not limited to color mixing and beam shaping. The back reflector 104 should be highly reflective in the wavelength ranges of the light sources. In some embodiments, the back reflector 104 can be 93% reflective or higher. In other embodiments, the back reflector 104 can be at least 95% reflective, at least 97% reflective, or at least 99% reflective.

Reflectors according to the present invention can comprise many different materials. In a one embodiment of the present invention, the back reflector 104 comprises a diffuse reflective surface. In some embodiments of the present invention, a reflector can comprise a polymeric or film material designed to reflect light emitted from an emitter on a light bar. In some embodiments the reflector surface can be white. In some embodiments the reflector comprises a white plastic, such as white plastic sheet(s) or one or more layers of microcellular polyethylene terephthalate ("MCPET"), and in some embodiments the reflector comprises white paper. In some embodiments reflector can comprise a white film, such as White97™ Film available from WhiteOptics, LLC, of New Castle, Del. In other embodiments the reflector can comprise metal, including but not limited to WhiteOptics™ Metal, available from WhiteOptics, LLC, or similar. In some embodiments, the reflector can be a plastic or metal device that is coated or painted with a reflective material, or another base material coated with a reflective material. Materials can also include specular reflectors which can help directly control the angle of redirected light rays, Lambertian reflectors, and combinations of diffuse, specular, and Lambertian reflectors.

Diffuse reflectors have the inherent capability to mix light from solid state light sources having different spectra (i.e., different colors). These diffuse reflectors are particularly well-suited for multi-source designs where two or more different spectra are to be mixed to produce a desired output color point. For example, LEDs emitting blue light may be used in combinations with LEDs emitting yellow (or blue-shifted yellow) light to yield a white light output, or LEDs emitting both blue and blue-shifted light can be used and yield a white light output. A diffuse reflector can eliminate the need for additional spatial color-mixing schemes that can introduce lossy elements into the system, although in some embodiments it may be desirable to use a diffuse reflector in combination with other diffusive elements. In some embodiments, the back reflector 104 is coated with a diffusive material. In some embodiments, the back reflector 104 can be coated with a phosphor material that converts the wavelength of at least some of the light from the light sources to achieve a light output of the desired color point.

In one embodiment, the back reflector 104 comprises a diffuse white reflective material. By using this or a similar material and positioning light sources to emit first toward the back reflector 104, several design goals are achieved. For example, the back reflector 104 performs a color-mixing function, effectively doubling the mixing distance and greatly increasing the surface area of the source. Additionally, the surface luminance is modified from bright, uncomfortable point sources to a much larger, softer diffuse reflection. A diffuse white material also provides a uniform luminous appearance in the output. Harsh surface luminance gradients (max/min ratios of 10:1 or greater) that would typically require significant effort and heavy diffusers to ameliorate in a traditional direct view optic can be managed with much less aggressive (and lower light loss diffusers) to achieve max/min ratios of 5:1, 3:1, or even 2:1.

The back reflector 104 can also be textured to, among other functions, improve color mixing and reduce imaging from the light sources. In one embodiment, the back reflector 104 comprises micro-mixing optics. In some embodiments, the texturing can be imparted to the reflector 104 by roughening the interior or exterior surface of the reflector 104. As in the case of imprinting, polycarbonate can be used. Also as in the case of imprinting, the intensity of the roughening can vary spatially relative to the center of the reflector and/or the positioning of the light source. The roughening can be accomplished in a number of different ways, regardless of whether the reflector is initially made by extrusion or by some other method. Textured reflectors are described in U.S. patent application Ser. No. 13/345,215 to Lu et al. and entitled "Light Fixture with Textured Reflector," and micro-optics and optical texturing are described in U.S. patent application Ser. No. 13/442,311 filed on Apr. 9, 2012, both of which are commonly assigned with the present application and both of which are fully incorporated by reference herein in their entirety. This type of texturing can also be used, for example, on optical elements such as lenses.

The reflector 104 when textured can provide color mixing and reduce color hot spots and reflections in a light fixture that uses multiple color emitters. As an example some fixtures include blue-shifted yellow plus red (BSY+R) LED systems, wherein the LED light source includes at least two groups of LEDs, wherein one group emits light having a dominant wavelength from 435 to 490 nm, and another group emits light having a dominant wavelength from 600 to 640 nm. In such a case, one group can be packaged with a phosphor, which, when excited, emits light having a dominant wavelength from 540 to 585 nm. In some embodiments, the first group emits light having a dominant wavelength from 440 to 480 nm, the second group emits light having a dominant wavelength from 605 to 630 nm, and the troffer emits light having a dominant wavelength from 560 to 580 nm.

As just one example of a textured reflector according to embodiments of the invention, thin extruded high reflectivity PC plates can have a pattern imprinted as part of the extrusion process, and the plates can be pressed onto an un-textured extruded PC back reflector substrate. One example of an imprinted pattern is a prismatic pattern, which can include repeated prismatic elements extending in all directions. Such a pattern can also be used in a lens material. Another example of an imprinted pattern is a cut keystone pattern. Alternatively, the entire reflector can be extruded with an imprinted pattern on the inside or bottom surface of the reflector. Either type of imprinting can be accomplished with a textured drum as part of the extrusion process. A roughening pattern can also be applied by roughening a reflector or a plate to be pressed on to a reflector substrate with sand blasting, sanding, or another roughening technology. Textured reflectors are described in detail in U.S. patent application Ser. No. 13/345,215 to Lu et al.

As best shown in FIGS. 1B and 1E, the back reflector 104 has a cross-section that is substantially parabolic on its sides with a flat portion connecting these two portions; however, many other shapes are possible. Also as shown in FIGS. 1B and 1E, the troffer 100 can be designed to have a reduced height profile, such as having a total height of about 2" or less. The shape of the back reflector 104 should be chosen to produce the appropriate reflective profile for an intended output.

A typical solid state lighting fixture will incorporate a heat sink that sits above the ceiling plane to dissipate conducted LED heat into the environment. Temperatures above office and industrial ceilings in a non-plenum ceiling regularly reach 35° C. As discussed herein, the bottom portion of the heat sink 106, including the fin structures if present, can be exposed to the air in the room beneath the troffer 100.

An exposed heat sink 106 can be advantageous for several reasons. For example, air temperature in a typical office room is much cooler than the air above the ceiling, obviously because the room environment must be comfortable for occupants; whereas in the space above the ceiling, cooler air temperatures are much less important. Additionally, room air is normally circulated, either by occupants moving through the room or by air conditioning. The movement of air throughout the room helps to break the boundary layer, facilitating thermal dissipation from the heat sink. Also, a room-side heat sink configuration prevents improper installation of insulation on top of the heat sink as is possible with typical solid state lighting applications in which the heat sink is disposed on the ceiling-side. This guard against improper installation can eliminate a potential fire hazard.

The troffer 100 is designed to be mounted to or within a ceiling. As best shown in FIG. 1B, the chamber portion 108 can be designed to cooperate with a mount bracket 112. The mount bracket 112 can include hook features that snap into place on the underside of a housing flange for easy installation. The mount bracket 112 may be mounted directly to a J-box on a ceiling. After the mount bracket 112 is mounted to the ceiling, the chamber portion 108 can be snapped into place using the hook-and-flange structure. In some embodiments, the housing 102 can then be slid from side to side for fine adjustment of position. Although a hook-and-flange attachment system is described herein, many other attachment systems are possible. The chamber portion 108 can include a hole 114 through which connection wires can pass. The mount bracket 112 can also have a corresponding hole.

FIG. 2 is a close-up top view of a mount bracket 212 attached to a fixture 200. The fixture 200 includes a housing 202 and a chamber portion 208, and the chamber portion 208 has a center hole 214 which can be used to either feed wiring or connect to the mount bracket 212. The mount bracket 212 includes hook portions 216 which can lock into flanges on the underside of the chamber portion 208 or, alternatively, another section of the housing 202. Various holes and slots 212*a* in the mount bracket 212 can be used to feed wiring into the chamber portion 208 to power the internal drive circuitry, emitters, and other electronic components. The mount bracket 212 is a universal mount bracket and can fit junction boxes ("J-boxes") of many different shapes sizes, including but not limited to circular and octagonal and 2" and 4".

FIG. 3A is a cut-away perspective view of a fixture 300 according to the present invention, with the cut plane within a chamber portion 308. FIG. 3B is a cut-away end view of the fixture 300 along the same cut plane. The cut-away view exposes the interior space 320 created by the chamber portion 308 of a housing 302. A heat sink 306 runs through the space, with light emitters such as LEDs 324 mounted on a lighting strip 322, which is itself mounted on a mount surface of the heat sink 306. In other embodiments, the light emitters 324 are mounted directly on the heat sink 306.

Electrical components may also be disposed within the interior space 320, such as connected to a circuit mount board 330 which is mounted within the space 320. Some examples of electrical components that can be included in embodiments of the present invention include power circuitry and drive circuitry including, for example, AC/DC driver circuitry and DC/DC driver circuitry, to name a few. At the most basic level a driver circuit may comprise an AC to DC converter, a DC to DC converter, or both. In one embodiment, the driver circuit comprises an AC to DC converter and a DC to DC converter both of which are located inside the interior space 320. In another embodiment, the AC to DC conversion is done remotely (i.e., outside the optical chamber), and the DC to DC conversion is done at the control circuit inside the optical chamber. In yet another embodiment, only AC to DC conversion is done at a control circuit within the interior space 320.

In the embodiment shown, a mount bracket 312 is connected to a chamber portion 308 using a hook-and-flange structure. As can be seen in FIGS. 3A and 3B, the bracket 312 comprises bracket hooks 326 while the chamber portion 308 comprises flanges 332. In the embodiment shown, the heat sink 306 is connected to the chamber portion 308 using a flange-and-slot structure with flanges 332 and slots 334. In some embodiments of fixtures according to the present invention, the flanges 332 and slots 334 run the entire length of the chamber portion 308. Many other connection systems between the bracket 312 and chamber portion 308 and between the heat sink 306 and the chamber portion 308 and/or housing 302 are possible, such as screws and/or adhesive, for example. Some of these alternate connection systems may be more permanent than hook-and-flange structures.

Many industrial, commercial, and residential applications call for white light sources. The troffer may comprise one or more emitters producing the same color of light or different colors of light. In one embodiment, a multicolor source is used to produce white light. Several colored light combinations will yield white light. For example, it is known in the art to combine light from a blue LED with wavelength-converted yellow (blue-shifted-yellow or "BSY") light to yield white light with correlated color temperature (CCT) in the range between 5000K to 7000K (often designated as "cool white"). Both blue and BSY light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The BSY light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al., which is commonly assigned with the present application and fully incorporated by reference herein in its entirety.

Many different types of emitters other than those described above can be used in embodiments of the present invention. In some embodiments the emitters are solid state emitters such as LEDs or LED packages. Many different LEDs can be used such as those commercially available from Cree Inc., under its DA, EZ, GaN, MB, RT, TR, UT and XT families of LED chips. Further, many different types of LED packages can be used in embodiments of the present invention. Some types of chips and packages are generally described in U.S. patent application Ser. No. 12/463,709 to Donofrio et al., entitled "Semiconductor Light Emitting Diodes Having Reflective Structures and Methods of Fabricating Same," U.S. patent application Ser. No. 13/649,052 to Lowes et al., entitled "LED Package with Encapsulant Having Planar Surfaces," and U.S. patent application Ser. No. 13/649,067 to Lowes et al., entitled "LED Package with Multiple Element Light Source and Encapsulant Having Planar Surfaces," all three of which are commonly assigned with the present application and all three of which are fully incorporated by reference herein in their entirety. The emitters can emit many different colors of light, with preferred emitters emitting white light (or chips emitting blue light, part of which is converted to yellow light to form a white light combination). One preferred embodiment of a package that can be used in a fixture according to the present invention comprises a substantially box shaped encapsulant, which results in a package emission that is broader than Lambertian. Many of these packages are shown and described in U.S. patent application Ser. No. 13/649,067 to Lowes et al., which is commonly assigned with the present application and fully incorporated by reference herein in its entirety. It is understood that in some embodiments the LED can be provided following removal of its growth substrate. In other embodiment, the LED's growth substrate can remain on the LED, with some of these embodiments having a shaped or textured growth substrate. In some embodiments when the LED's growth substrate remains on the LED, the LED is flip-chip mounted onto a light strip or mount surface.

In some embodiments, the LEDs can comprise a transparent growth substrate such as silicon carbide, sapphire, GaN, GaP, etc. The LED chips can also comprise a three dimensional structure and in some embodiments, the LEDs can have structure comprising entirely or partially oblique facets on one or more surfaces of the chip.

In one embodiment, at least some of the light emitters 324 are LED chips and/or packages which can, in some embodiments, have an emission pattern that is broader than Lambertian, such as, for example, those described in U.S. patent application Ser. Nos. 13/649,052 and 13/649,067. In another preferred embodiment, these LED chips and/or packages are used in combination with standard Lambertian emitters. In another embodiment, the light emitters 324 are phosphor-coated LEDs such as, for example, those described in U.S. patent application Ser. Nos. 11/656,759 and 11/899,790, both to Chitnis et al. and both entitled "Wafer Level Phosphor Coating Method and Devices Fabricated Utilizing Method," both of which are commonly assigned with the present application and both of which are fully incorporated by reference herein in their entirety. In one embodiment the light emitters 324 are phosphor-coated LED chips and/or packages with emission patterns that are broader than Lambertian. In another preferred embodiment, these LEDs emit in the blue spectrum and are covered in a yellow phosphor, resulting in a white emission. In another embodiment the light emitters 324 have a Lambertian emission profile.

Figure 4A:
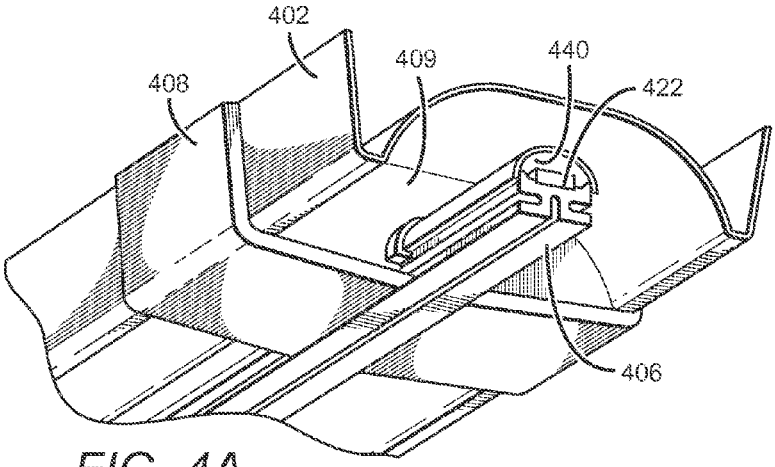
FIGS. 4A and 4B are magnified perspective cut-away views of sections of light fixtures according to an embodiment of the present invention.

FIG. 4A is a perspective cut-away view of the fixture 400 from a bottom side angle, with the cut-plane along a portion of a housing 402 outside of a chamber portion 408. The fixture 400 also includes chamber portion walls 409, which enclose an interior space (not shown) similar to that shown in FIGS. 3A and 3B. In the embodiment shown, the heat sink 406 is connected to the chamber portion 408 using a flange-and-slot system similar to that shown in FIGS. 3A and 3B.

Figure 6:
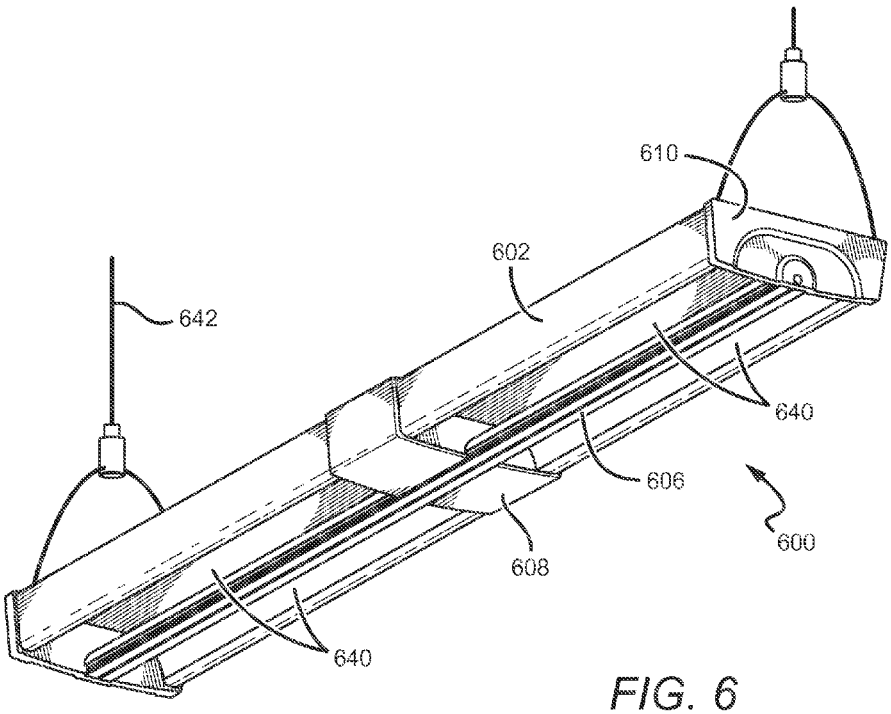
FIG. 6 is a perspective view of a light fixture according to an embodiment of the present invention suspended from a ceiling.

The fixture 400 also includes a lens 440. The lens 440 can comprise a diffusive material to help with color mixing. The lens can also function to protect the consumer from coming into contact with high voltage elements such as LEDs. In the embodiment shown, the lens 440 has a semi-circular cross-section and is mounted to the heat sink 406 over the emitters (not shown). While the lens 440 is shown mounted on the heat sink 406, many other arrangements are possible. For example, a lens plate, which will be discussed in further detail with regard to FIG. 6, could be mounted between a housing 402 and the heat sink 406 using, for example, slots 434, such that the slots 434 connect to the chamber portion 408 and connect to a lens in areas outside of the chamber portion 408. As will be discussed in further detail, lenses can be textured and/or include microlens structures, for example. Textured lenses and lenses with microlens structures are discussed in detail in U.S. patent application Ser. No. 13/442,311 to Lu et al.

Figure 4B:
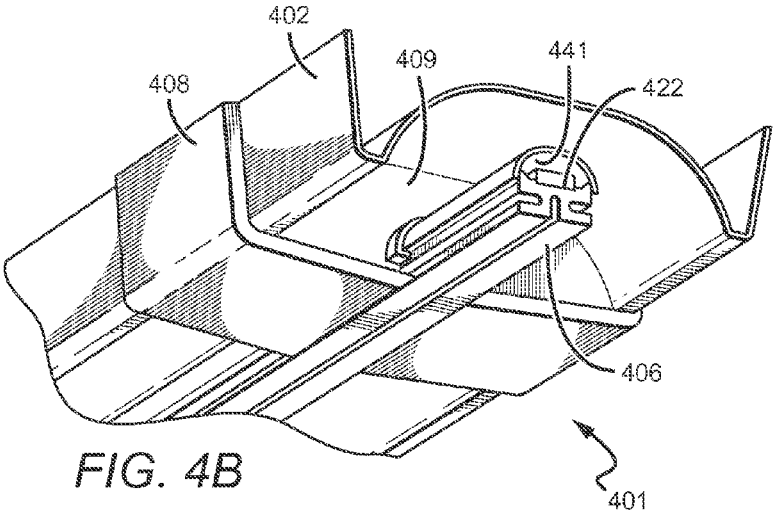

FIG. 4B is a perspective cut-away view of the fixture 401 from a bottom side angle. The fixture 401 comprises many of the same components as the fixture 400, and corresponding reference numerals are used to indicate corresponding elements. Instead of a lens 440, the fixture 401 comprises a flame barrier 441 which is required to cover high voltage emitters on a light strip 422. The flame barrier 441 can be made of, for example, glass or a UL94 5 VA rated transparent plastic. In some embodiments, the flame barrier 441 comprises cutouts through which part of the emitter (not shown, but situated similarly to light emitters 324 of FIG. 3), such as an LED dome, can protrude, while the flame barrier 441 still covers the high voltage portions of the LED to meet engineering requirements. Such embodiments can help to minimize or even eliminate the optical losses associated with the flame barrier 441. Some embodiments can comprise both a lens 440 and a flame barrier 441, and in some embodiments a single element can combine the characteristics of both and/or perform both functions.

Figure 5:
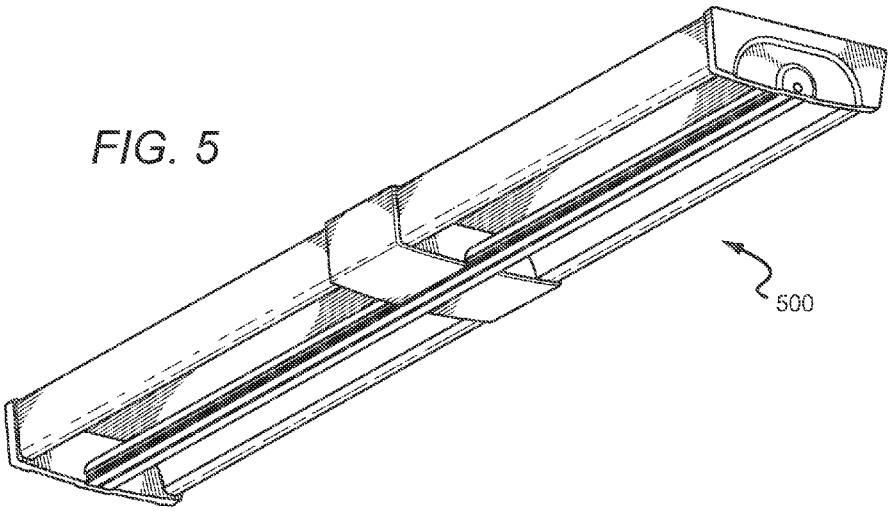
FIG. 5 is a perspective view of a light fixture according to an embodiment of the present invention mounted to a ceiling.

As previously described, fixtures according to the present invention can be mounted to a ceiling. Such an embodiment is shown in FIG. 5. The fixture 500 can be mounted to the ceiling using a mount bracket (not shown). Fixtures according to the present invention can also be mounted within a cavity in the ceiling by various methods, including by using a mount bracket. Fixtures according to the present invention can also be suspended from a ceiling, such as the fixture 600, seen in FIG. 6. The fixture 600 includes two suspension devices 642, although any number of suspension devices is possible. In embodiments where wiring is not directly connected to the chamber portion 608 (i.e., an embodiment unlike that of the troffer 100, where wiring enters the chamber portion 108 through a hole 114), wiring can be connected to the chamber portion in a less direct manner. For instance, wiring can be connected to the troffer 600 and the chamber portion 608 by running wiring through one or more of the suspension devices 642, through the housing 602, and to the chamber portion 608. Alternatively, a suspension device can connect directly to the chamber portion 608, whether the chamber portion 608 is in the center of the fixture 600 or on one end. In other embodiments, a fixture can be suspended using simple chains or cords, for example.

The fixture 600 also includes a textured back reflector 640. The back reflector 640 can be made of many different materials. The texturing on the back reflector 640 can comprise materials and manufactured using methods described in U.S. patent application Ser. No. 13/345,215 to Lu et al. and/or U.S. patent application Ser. No. 13/442,311.

The fixture 600 optionally can include lens plates (not shown). The lens plates can be mounted between the housing 602, the heat sink 606, and/or the chamber portion 608. The lens plates can cooperate with one or more of the housing 602, the heat sink 606, or the chamber portion 608. The lens plate can be mounted to the heat sink 606 using, for example, heat sink slots (not shown) similar to the slots 434 shown in FIG. 4. In one embodiment the lens plates are also mounted to the chamber portion 608 and/or one of the end caps 610, although this is not always necessary.

Troffers according to the present invention can comprise many different types of lens plates. Lens plates can serve to provide physical protection to components within the troffer, such as LEDs. Lens plates can achieve this by, for example, preventing physical damage or dust accumulation, which can negatively affect the troffer's emission efficiency, intensity, and/or profile. Lens plates also serve to improve the uniformity of the troffer emission. Depending upon the type of emitters and the reflector used in a troffer, bright "hotspots" of light can sometimes be seen on the reflector above the emitter sources. These hotspots are sometimes undesirable and can negatively affect emission uniformity. Lens plates can help to reduce the appearance of these hotspots to a viewer by spreading the light reflected from these hotspots across a wider viewing area. In some cases the light reflected from these hotspots can be spread across the entire luminaire. Even in troffers wherein no hotspots or insubstantial hotspots are formed, lens plates can help to diffuse light, broaden the troffer's emission profile, focus the troffer's emission profile, and/or create a more uniform appearance.

Lens plates can be textured in order to achieve one or more of the above goals. For example, a lens plate can include facets, or can comprise one or more thin films which have linear or discrete facets or other texturing. Other examples of lens plates have deglaring prisms. One embodiment of a lens plate used in a troffer according to the present invention comprises extruded acrylic with either a diffuser built into the acrylic or a diffuser film coating. Other embodiments of lens plates that can be used in the present invention include diffuse lenses, which scatter all incident light. Further embodiments can comprise acrylics, PMMAs, and/or diffusing additives. Some embodiments can comprise clear acrylics. The types of lens plates described herein are only a few of the types of lenses that can be used, and are in no way intended to be limiting. Types of lenses which can be used in fixtures according to the present invention are described in U.S. patent application Ser. No. 13/442,311 to Lu et al.

FIGS. 7A-7E are bottom perspective, top perspective, bottom, side, and end views of another fixture 700 according to the present invention. The fixture 700 comprises a housing 702, a back reflector 704, a heat sink 706, and two end caps 710. The fixture 700 also comprises a chamber portion 708. As discussed with regard to the heat sink 106 and the chamber portion 108 of FIG. 1, in one embodiment the heat sink 706 is continuous through the chamber portion 708. Unlike the chamber portion 108 in FIG. 1, the chamber portion 708 is not in the center of the fixture 700, but instead at one longitudinal end of the fixture 700. In the embodiment shown the chamber portion 708 is against an end cap 710*a*, although some embodiments do not comprise end caps 710*a*, 710*b*. Various holes and slots on the back side of the chamber portion 708 are used to feed wiring into the chamber portion 708 to power the internal drive circuitry, emitters, and other electronic components. The center hole 714 can be used to feed wiring, or can be used to connect the fixture 700 to a mount bracket similar to the mount bracket 212 shown in FIG. 2. Further, while the chamber portion 708 is on the end of the fixture 700, in other embodiments it can be anywhere along the fixture 700. Further, while the fixture 700 comprises a single chamber portion 708, other embodiments may comprise two or more chamber portions, such as one chamber portion at each longitudinal end of a fixture.

Figure 7A:
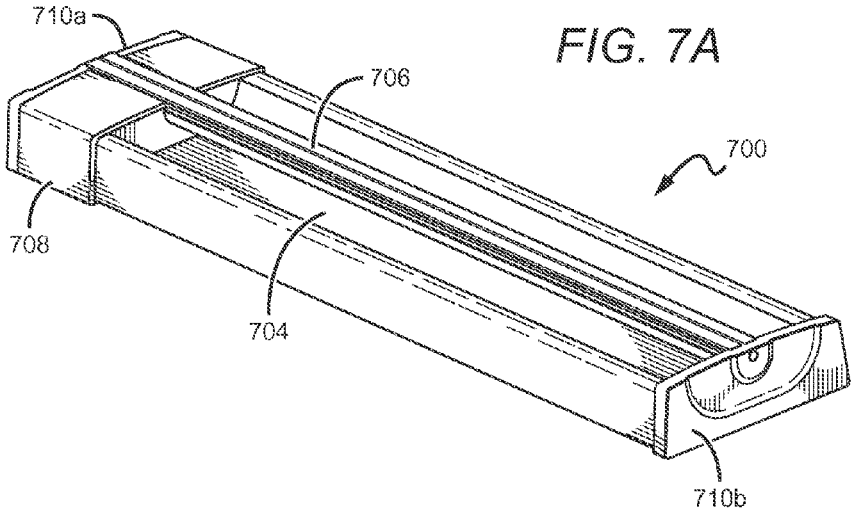
FIGS. 7A-E are bottom perspective, top exploded perspective, top, side, and end views of a light fixture according to an embodiment of the present invention.
Figure 7B:
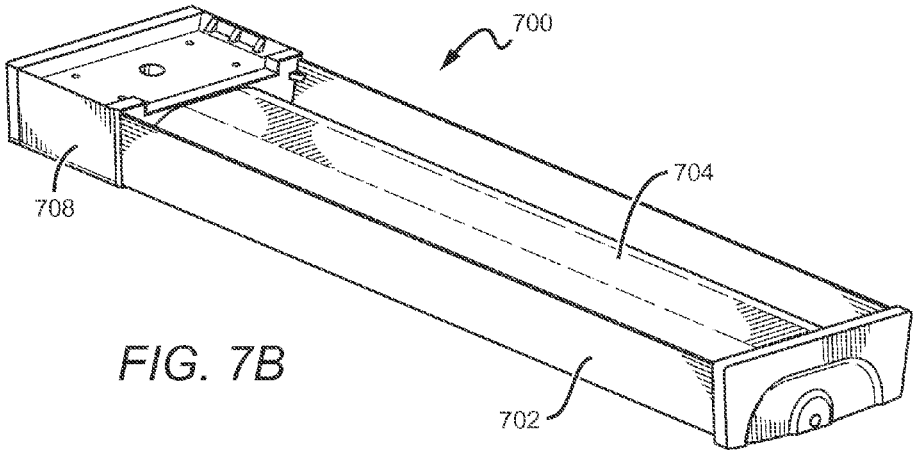
Figure 7E:
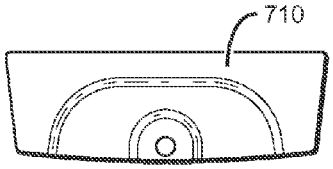
Figure 7C:
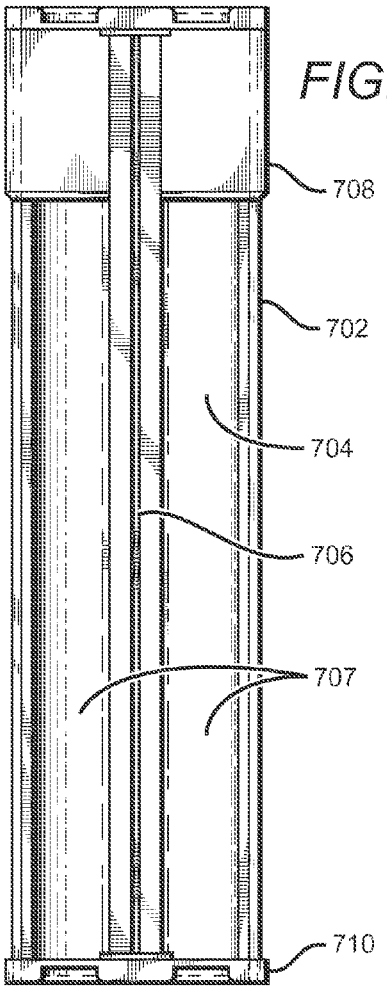
Figure 7D:
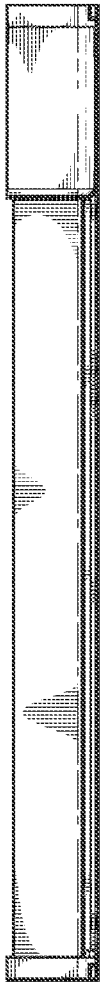

Embodiments similar to the fixture 700 can also comprise one or more lenses. For example, lenses could occupy the two areas 707 defined by the housing 702, the heat sink 706, and the chamber portion 708, as shown in FIG. 7C. In another embodiment, a lens is on the heat sink and over any emitters mounted thereon. In yet another embodiment, only one lens is needed. The lens can pass below the heat sink 706 so as to traverse the fixture 700 while also occupying the two areas 707. In a similar embodiment, the heat sink 706 is on the lens.

Figure 8:
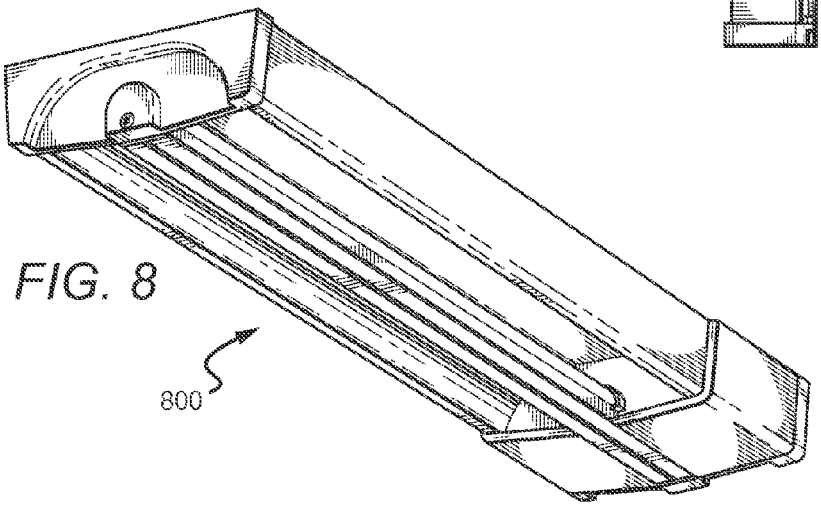
FIG. 8 is a perspective view of a light fixture according to an embodiment of the present invention mounted to a ceiling.

Similar to the internal structure of the chamber portion 308 shown in FIG. 3, the chamber portion 708 provides an internal space for disposing power and driver circuitry and wiring connections. The space protects the connections from outside elements and also helps to prevent shock by users during installation. Similar to the chamber portion 108 shown in FIG. 1 and the chamber portion 308 shown in FIG. 3, the chamber portion 708 can be designed to cooperate with a mount bracket such as the mount bracket 112 shown in FIG. 1. The mount bracket can be mounted directly to a J-box or a ceiling. After the bracket is mounted to a ceiling, the chamber portion 708 can be snapped into place using the hook-and-flange structure. In the embodiment shown, the end cap opposite the chamber portion 710*b* can be attached to the ceiling using screws, hooks, wire, cord, or many other attachment mechanisms. A troffer 800 similar to the troffer 700 is shown mounted to a ceiling in FIG. 8. In other embodiments, the entire fixture 700 can be suspended from a ceiling, such as with a wire or cord.

FIGS. 9A-9G are bottom perspective, top perspective, bottom, top, side, end, and exploded view of another fixture 900 according to the present invention. The fixture 900 comprises a housing 902, a back reflector 904, a heat sink 906, and two end caps 910. The fixture 900 also comprises a chamber portion 908 and a mount bracket 912. As shown in the figures, the heat sink 906 is continuous through the chamber portion 908. Unlike the chamber portion 708 in FIG. 7, the chamber portion 908 is in the center of the fixture 900.

Figure 9A:
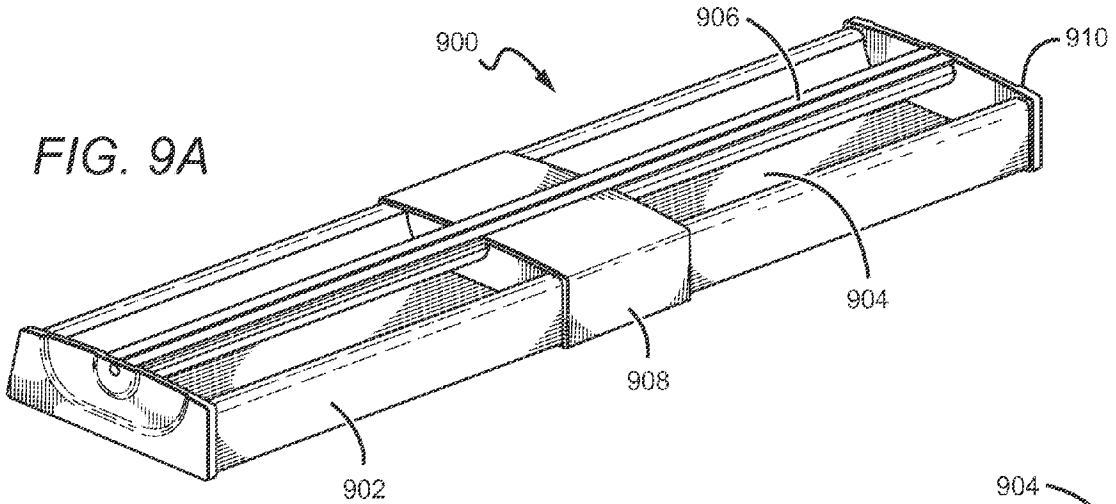
FIGS. 9A-G are bottom perspective, top perspective, bottom, top, side, end, and top perspective exploded views of a light fixture according to an embodiment of the present invention.
Figure 9B:
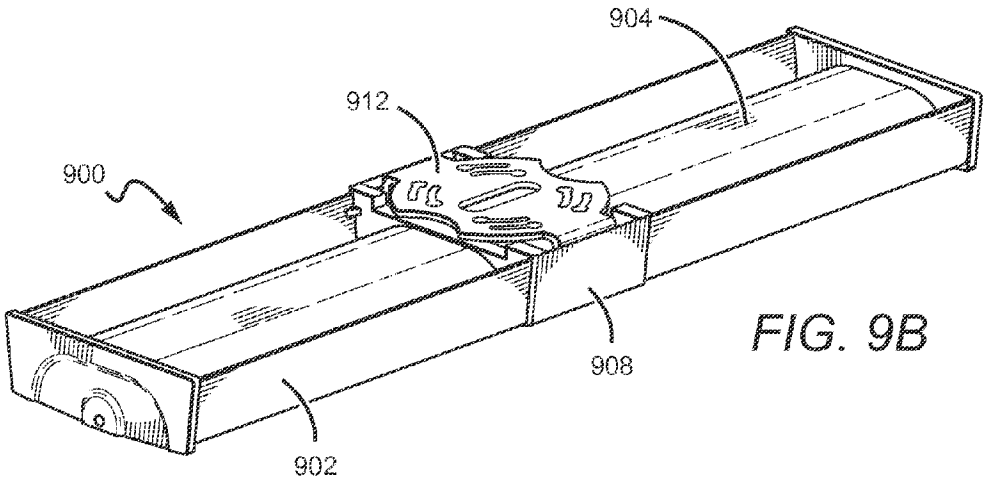
Figure 9C:
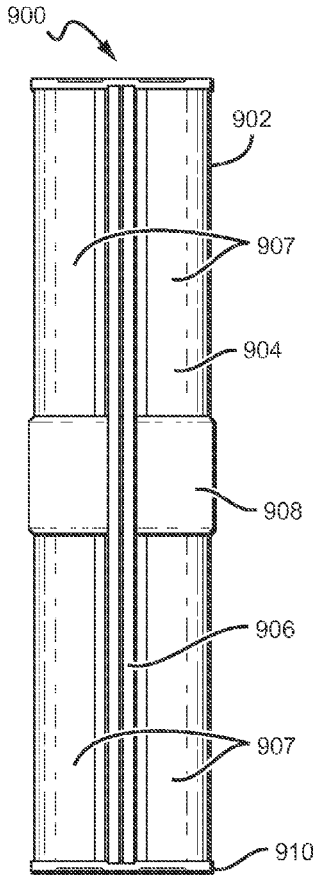
Figure 9E:
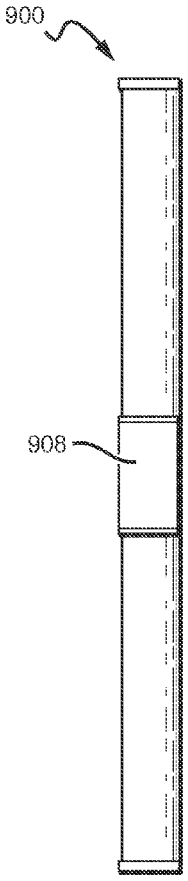
Figure 9D:
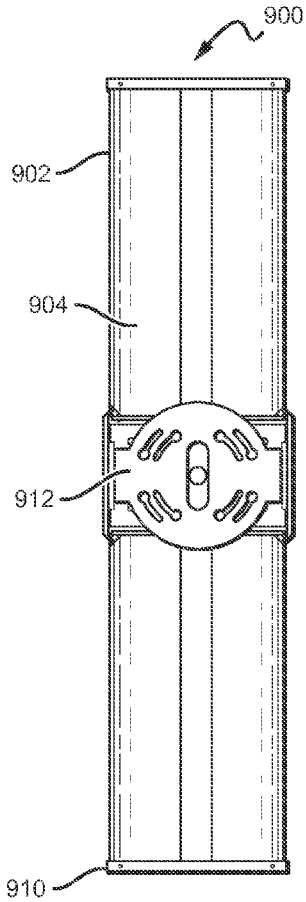
Figure 9F:
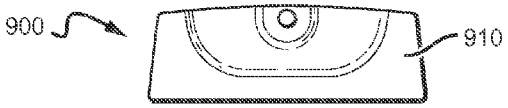

An embodiment similar to that of the fixture 900 can also comprise lenses. By placing the chamber portion 908 in the center of the fixture 900, four lenses can occupy the four areas 907 defined by the housing 902, the heat sink 906, and the chamber portion 908, as shown in FIG. 9C. Smaller lenses can be more cost efficient to manufacture than larger lenses. Thus, utilizing smaller lenses occupying the four areas 907 may be more cost effective than utilizing larger lenses occupying the two areas 707 in FIG. 7C.

Figure 9G:
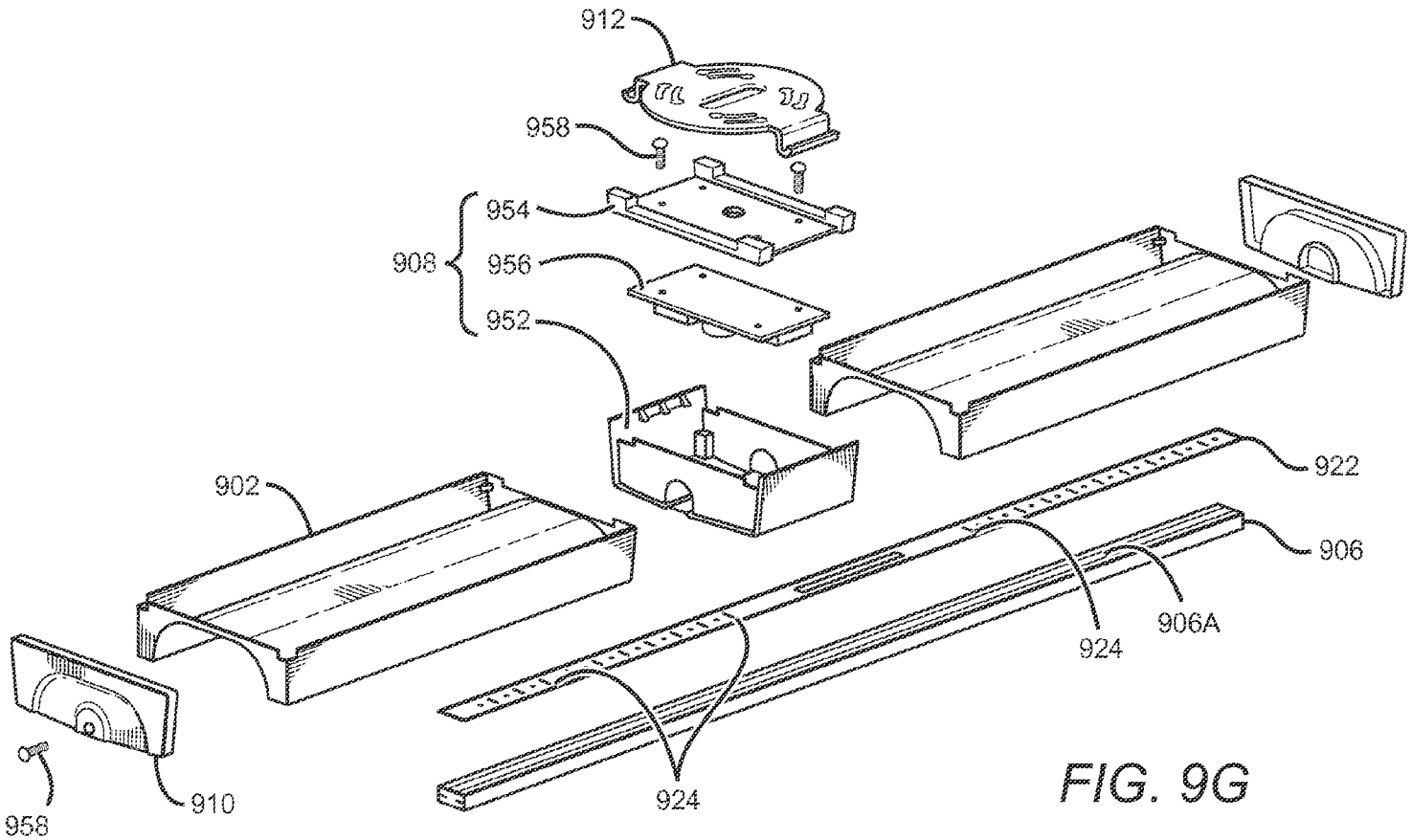

FIG. 9G is an exploded top perspective view of the fixture 900. As shown, the chamber portion 908 comprises the main housing 952, the back housing 954, and electronics 956 housed within the chamber portion 908. The electronics can include, for example, circuits on a PCB. Components of the fixture 900 can be attached to one another using various attachment means. As shown in FIG. 9G, one embodiment uses screws 958 as an attachment means. End caps 910, if present, can also be attached to the main housing 902 using an attachment means such as screws 958. Similar to the configuration shown in FIG. 3B, the heat sink 906 has a light strip 922 over a portion 906A of the heat sink 906. The light strip 922 includes light emitters or sources 924.

Figure 10:
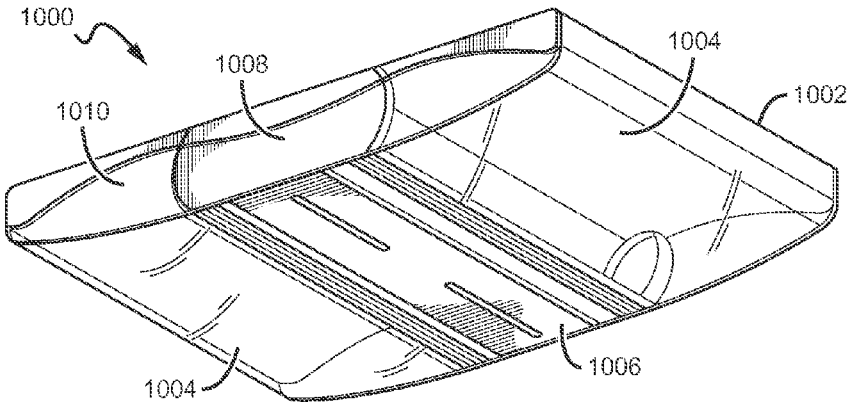
FIG. 10 is a bottom perspective view of a light fixture according to an embodiment of the present invention.

Smaller fixtures according to the present invention are also possible. FIG. 10 is a bottom perspective view of a fixture according to the present invention. A fixture 1000 can have a length of about 10", width of about 17", and a height of about 2.5" or less or about 2.0" or less, although these dimensions are purely exemplary. The fixture 1000 comprises a housing 1002, one or more back reflectors 1004, one or more heat sinks 1006, and one or more end caps 1010. As opposed to the chamber portion 108 of FIG. 1 which ran perpendicular to the length of the fixture 100 and the heat sink 106 and from end cap 110 to end cap 110, the chamber portion 1008 can run longitudinally from end cap to end cap and parallel with the heat sink 1006. The chamber portion 1008 can cooperate with or be on the heat sink 1006, and in some embodiments the heat sink 1006 dissipates heat generated from components within the chamber portion 1008.

Figure 11:
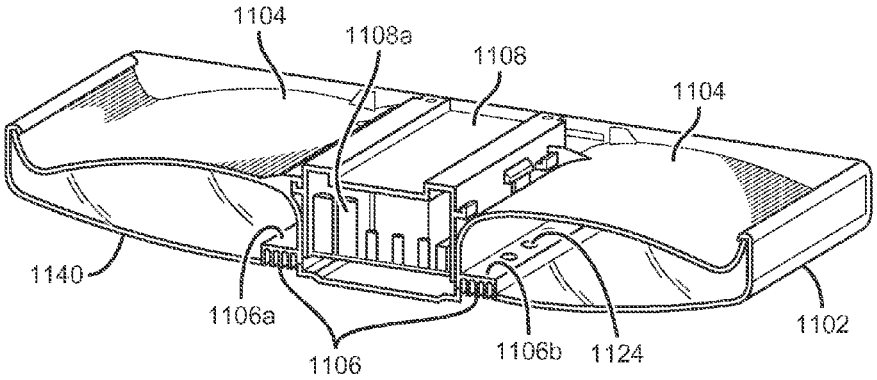
FIG. 11 is a perspective transverse cut-away view and a perspective longitudinal cut-away view of a light fixture according to an embodiment of the present invention.

FIG. 11 is a cut-away perspective view of the fixture 1100 with the cut-plane transverse to the chamber portion 1108. The chamber portion 1108 houses electronic components 1108*a*. The fixture 1100 has two internal surfaces, in this case back reflectors 1104. As shown, the fixture 1100 comprises a heat sink 1106 with two mount surfaces 1106*a* and 1106*b*. In some embodiments the heat sink and one or more mount surfaces are all integral with one another. Some other embodiments may comprise two or more separate heat sinks, each with its own integral one or more mount surfaces.

The fixture 1100 also comprises a housing 1102 and a chamber portion 1108. This chamber portion is along the top length of the heat sink 1106. In the embodiment shown, the heat sink 1106 can provide a path for thermal dissipation from emitters on the mount surfaces 1106*a* and 1106*b* as well as the chamber portion 1108.

Light emitters 1124 are mounted on the mount surfaces 1106*a* and 1106*b*. These light emitters 1124 emit light toward the two back reflectors 1104. The back reflectors 1104 are shaped so as to produce the desired fixture light profile. In the embodiment shown the emitters 1124 have a primary emission surface facing straight up. Thus, the back reflectors 1124 are shaped to divert light away from the chamber portion 1108 and toward lens plates 1140, through which the light will pass. In other embodiments, the mount surfaces 1106*a* and 1106*b* can be angled, such as being angled away from the chamber portion 1108, and the shape of the back reflectors 1104 can be adjusted accordingly. While the embodiment shown comprises two back reflectors 1104, other embodiments may comprise a single back reflector with two internal surfaces. For example, the back reflector could pass over the chamber portion 1108 and thus form an internal surface on either side of the chamber portion 1108.

The fixture 1100 also comprises one or more lens plates 1140. Lens plates can serve to provide physical protection to components within the troffer, such as LEDs. Lens plates can achieve this by, for example, preventing physical damage or dust accumulation, which can negatively affect the troffer's emission efficiency, intensity, and/or profile. Lens plates also serve to improve the uniformity of the troffer emission. Depending upon the type of emitters and the reflector used in a troffer, bright "hotspots" of light can sometimes be seen on the reflector above the emitter sources. These hotspots are sometimes undesirable and can negatively affect emission uniformity. Lens plates can help to reduce the appearance of these hotspots to a viewer by spreading the light reflected from these hotspots across a wider viewing area. In some cases the light reflected from these hotspots can be spread across the entire luminaire. Even in troffers wherein no hotspots or insubstantial hotspots are formed, lens plates can help to diffuse light, broaden the troffer's emission profile, and/or create a more uniform appearance.

In one embodiment, the lens plate 1140 comprises a diffusive element. A diffusive exit lens functions in several ways. For example, it can prevent direct visibility of the sources and provide additional mixing of the outgoing light to achieve a visually pleasing uniform source. However, a diffusive lens plate can introduce additional optical loss into the system. Thus, in embodiments where the light is sufficiently mixed by the back reflector or by other elements, a diffusive exit lens may be unnecessary. In such embodiments, a transparent glass lens plate can be used, or the lens plate can be removed entirely. In still other embodiments, scattering particles may be included in the lens plate 1140. Some embodiments may include a specular or partially specular back reflector. In such embodiments, it may be desirable to use a diffuse lens plate.

Diffusive elements in the lens plate 1140 can be achieved with several different structures. A diffusive film inlay can be applied to the top- or bottom-side surface of the lens plate 1140. It is also possible to manufacture the lens plate 1140 to include an integral diffusive layer, such as by coextruding the two materials or by insert molding the diffuser onto the exterior or interior surface. A clear lens may include a diffractive or repeated geometric pattern rolled into an extrusion or molded into the surface at the time of manufacture. In another embodiment, the lens plate material itself may comprise a volumetric diffuser, such as an added colorant or particles having a different index of refraction, for example.

One embodiment of a lens plate according to the present invention is faceted. Faceted lenses can use bumps or pips to scatter light in a predictable manner. Faceted lenses can comprise prisms, such as deglaring and/or linear prisms. A lens plate can also comprise films with linear or discrete facets. The properties of such films can be enhanced if a plurality of films is stacked. Such films can be on the troffer side of the lens plate, emission side of the lens plate, or both. In some embodiments, a lens can be used to optically shape the outgoing beam with the use of microlens structures, for example. Microlens structures are discussed in detail in U.S. patent application Ser. No. 13/442,311.

Figure 12:
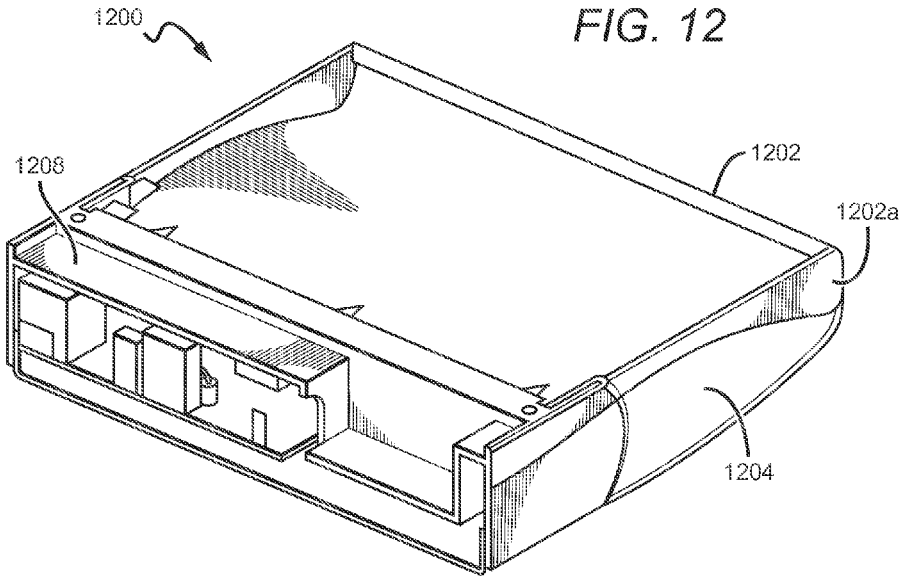
FIG. 12 is a perspective longitudinal cut-away view of a light fixture according to an embodiment of the present invention.

FIG. 12 is a cut-away perspective view of the fixture 1200 with the cut-plane longitudinal along the chamber portion 1208. As shown, in this embodiment the chamber portion 1208 does not run the entire length of the troffer 1200. In other embodiments the chamber portion runs the entire length of the troffer. In the embodiment shown, the housing 1202 comprises a portion 1202*a* that is over the reflector 1204. In other embodiments, the reflector 1204 can serve as the back surface of the troffer 1200.

Figure 13:
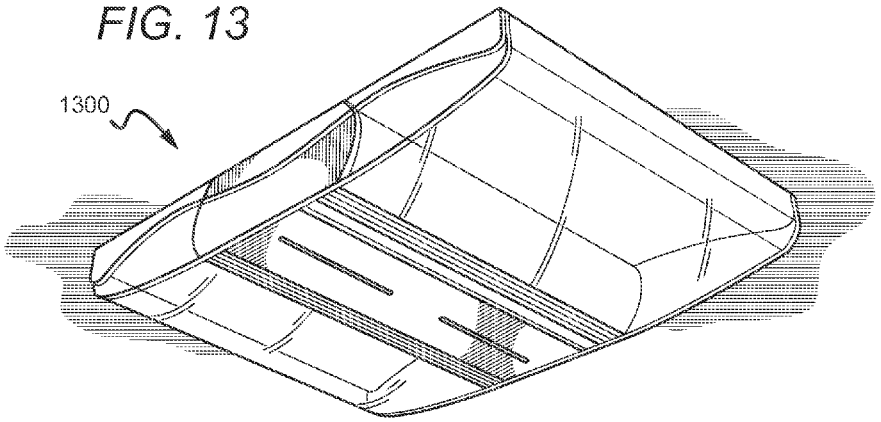
FIG. 13 is a perspective view of a light fixture according to an embodiment of the present invention mounted to a ceiling.

FIG. 13 is a perspective view of a troffer 1300 similar to the troffers 1100 and 1200 shown mounted to a ceiling. In other embodiments, the entire fixture 1300 can be suspended from a ceiling, such as with a wire or cord.

In one embodiment of the present invention, multiple fixtures (e.g., one or more of the fixture 100, fixture 700, and/or fixture 900) can be linked together to form a longer fixture which, for example, could be used to provide continuous lighting in a hallway. In one embodiment, the end caps of the fixture ends being joined (if present) are removed and an attachment means is used to connect two fixtures. Examples of attachment means include, but are not limited to, a joiner plate, end caps with incorporated attachment mechanisms, and double-sided end caps. In another embodiment, fixtures can have integral attachment means. For example, a fixture can have male attachment means on one end and female attachment means on the other end. The attachment means and methods described above are merely exemplary, as many different devices and methods for connecting multiple fixtures are possible.

Figures 14A, 14B:
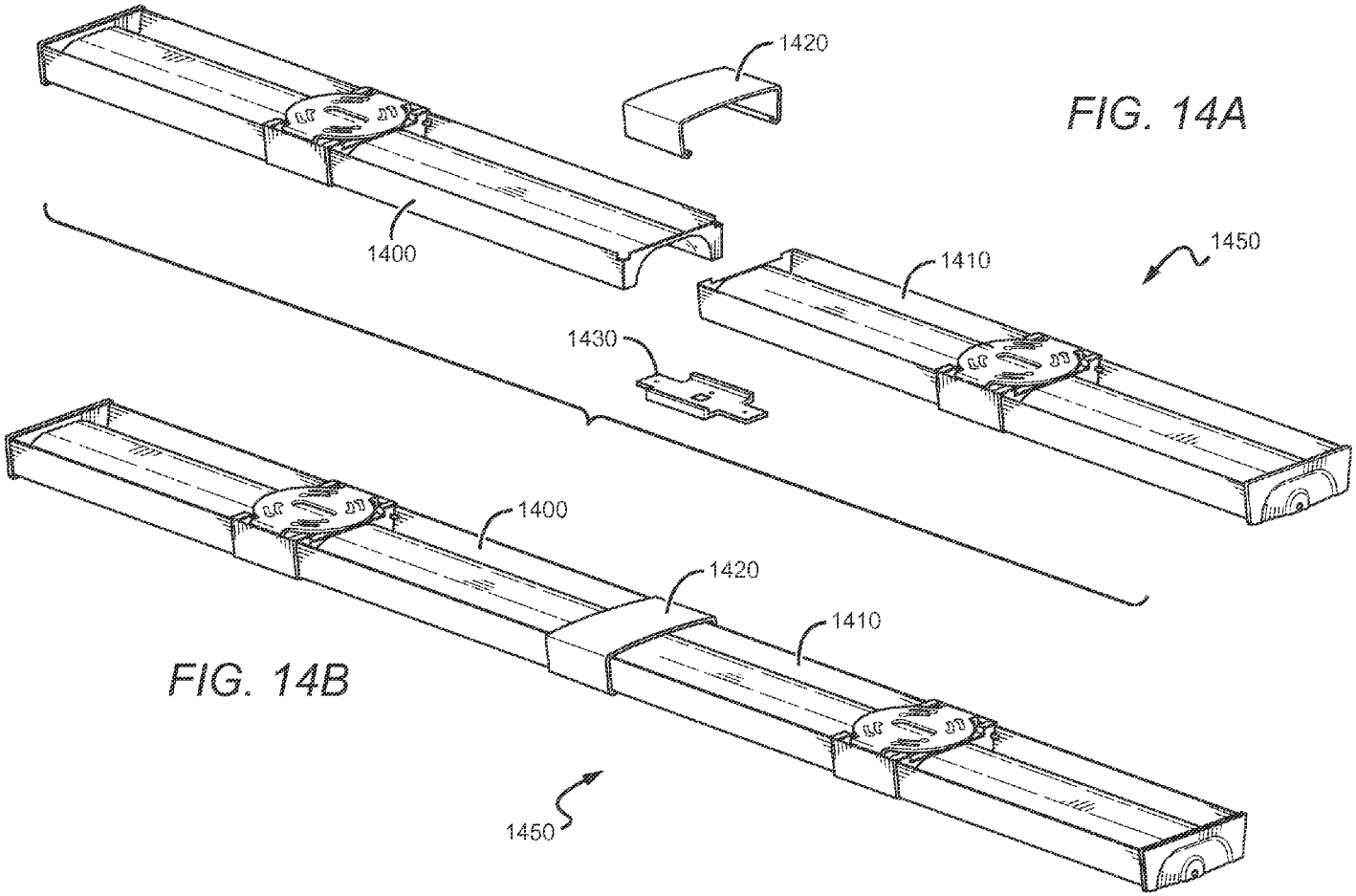
FIGS. 14A and 14B are perspective views of a light fixture according to an embodiment of the present invention.

FIG. 14 shows an embodiment of two fixtures 1400,1410 similar in many respects to the fixture 900 from FIG. 9, and a joiner structure comprising a sleeve 1420 and a mount plate 1430. Each of the fixtures 1400,1410 has had one end cap removed. The mount plate 1430 is attached using screws, for example, to the fixtures 1400,1410, and the sleeve 1420 wraps around to cover the interface. Sleeves contoured to match the backsides of fixtures are also possible, as are joiner structures without sleeves. An extended fixture 1450, comprising the two smaller fixtures 1400,1410 and the joiner structure comprising the sleeve 1420 and mount plate 1430, is shown in FIG. 14B. Additional fixtures may be added to the ends of the extended fixture 1450 in either direction to create an extended fixture having a particular desired length. Extended fixtures are possible for fixtures using any type of mount system, including but not limited to ceiling mounted, surface mounted, wall mounted, pendant mounted, and suspended fixtures.

It is understood that embodiments presented herein are meant to be exemplary. Embodiments of the present invention can comprise any combination of compatible features shown in the various figures, and these embodiments should not be limited to those expressly illustrated and discussed. Although the present invention has been described in detail with reference to certain preferred configurations thereof, other versions are possible. Therefore, the spirit and scope of the invention should not be limited to the versions described above.

We claim:

1. A light fixture comprising:

a housing shaped to define an interior surface;

a back reflector on said interior surface;

a heat sink spanning the length of said housing; and a chamber portion defining an internal space shaped to house electrical components, wherein said chamber portion cooperates with said heat sink and at least a portion of said heat sink passes through said chamber portion.

2. The light fixture of claim 1, further comprising at least one end cap on one end of said housing, said housing and said heat sink joining to said end cap.

3. The light fixture of claim 1, further comprising at least one light source on a mount surface of said heat sink such that said at least one light source emits light that is incident on said back reflector.

4. The light fixture of claim 3, further comprising a lens on said heat sink and over said at least one light source.

5. The light fixture of claim 3, further comprising a flame barrier on said heat sink and over said at least one light source.

6. The light fixture of claim 3, further comprising a flame barrier partially over said at least one light source;

wherein a portion of said at least one light source protrudes through said flame barrier.

7. The light fixture of claim 1, further comprising a removable universal mount bracket attached to an external back side surface of said chamber portion.

8. The light fixture of claim 1, wherein said back reflector is textured.

9. The light fixture of claim 1, wherein said back reflector comprises micro-mixing optics.

10. The light fixture of claim 1, wherein said chamber portion is disposed in the center region of said housing.

11. The light fixture of claim 1, wherein said housing comprises at least a portion of an interior surface on either side of said chamber portion.

12. The light fixture of claim 1, wherein said chamber portion is disposed at one end of said housing.

13. The light fixture of claim 1, wherein said housing is elongated and said chamber portion is transverse to said elongated housing.

14. The light fixture of claim 1, further comprising first and second end caps, wherein said chamber portion runs longitudinally from said first end cap toward said second end cap.

15. The light fixture of claim 1, further comprising first and second end caps;

wherein said chamber portion runs longitudinally between said first and second end caps.

16. The light fixture of claim 1, further comprising lens plates extending away from both sides of said heat sink toward said back reflector.

17. The light fixture of claim 1, wherein said elongated housing comprises extruded plastic.

18. The light fixture of claim 1, wherein said light fixture is configured to be mounted to a ceiling.

19. The light fixture of claim 1, wherein said light fixture is mounted such that it is recessed within a ceiling.

20. The light fixture of claim 1, wherein said light fixture is suspended from a ceiling by one or more suspension devices.

21. The light fixture of claim 1, wherein said internal space houses electrical components; and wherein said electrical components comprise an AC to DC converter.

22. The light fixture of claim 1, wherein said internal space houses electrical components; and wherein said electrical components comprise an AC to DC converter and a DC to DC converter.

23. A light fixture comprising:

a housing shaped to define two or more interior surfaces; a back reflector on each of said interior surfaces;

a heat sink proximate to said back reflectors and spanning the length of said housing;

a chamber portion defining an internal space shaped to house electrical components, wherein said chamber portion cooperates with said heat sink;

at least one light source on a mounting surface of said heat sink such that said at least one light source is aimed to emit light toward at least one of said back reflectors.

24. The light fixture of claim 23, further comprising first and second end caps;

wherein said chamber portion runs from said first end cap toward said second end cap.

25. The light fixture of claim 24, wherein said chamber portion runs from said first end cap to said second end cap.

26. A light fixture comprising:

a housing having a length and defining an interior space;

a back reflector in said interior space;

a heat sink running from a first end of said housing to a second end of said housing and proximate to said back reflector;

a plurality of light sources on said heat sink and facing said back reflector;

a chamber portion between said first and second ends of said housing.

* * * * *